United States Patent [19]

Hohol et al.

[11] Patent Number: 4,747,172

[45] Date of Patent: May 31, 1988

[54] MEDICAL DEVICE TRANSPORTER

[75] Inventors: Larry Hohol, Hunlock Creek, Pa.; Donald D. deVries, Jr., Balboa Island, Calif.; Howard Konishi, Woodinville, Wash.

[73] Assignee: Penox Technologies, Inc., Pittston, Pa.

[21] Appl. No.: 667,889

[22] Filed: Nov. 2, 1984

[51] Int. Cl.[4] ..... A47B 23/02; A47C 21/00

[52] U.S. Cl. ..... 5/507; 5/508; 206/557; 248/201

[58] Field of Search ..... 5/82 R, 507, 503, 508, 5/424; 108/1; 248/201; 297/439, 325; 206/557

[56] References Cited

U.S. PATENT DOCUMENTS

| | | | |
|---|---|---|---|
| 2,054,098 | 9/1936 | Rich | 108/1 |
| 2,535,112 | 12/1950 | Woody | 5/507 |
| 3,504,386 | 4/1970 | Rossi et al. | 5/81 R |
| 3,954,100 | 5/1976 | Sem-Jacobsen | 5/508 |
| 4,060,079 | 11/1977 | Reinhold, Jr. | 5/82 R |
| 4,352,991 | 10/1982 | Kaufman | 5/508 |
| 4,404,698 | 9/1983 | Koncelik et al. | 5/507 |
| 4,489,454 | 12/1984 | Thompson | 5/508 |

FOREIGN PATENT DOCUMENTS

| | | | |
|---|---|---|---|
| 755906 | 4/1967 | Canada | 297/439 |
| 1460553 | 10/1966 | France | 5/507 |
| 580991 | 8/1958 | Italy | 5/507 |

*Primary Examiner*—Alexander Grosz
*Attorney, Agent, or Firm*—Wegner & Bretschneider

[57] ABSTRACT

A single piece molded plastic instrumentation holding bridge for holding instrumentation and probes to be used with a patient laying on a stretcher is disclosed. The bridge includes depending legs which have recesses for engagement with arms mounted on the stretcher, and a surface formed by said legs which allows the bridge to be placed on the ground wherein the top surface of the bridge is at an oblique angle with respect to a horizontal plane. This invention provides a convenient and secure means for holding instrumentation on a stretcher while a patient is moved. Instrumentation may be either patient monitoring equipment, or life support equipment for the patient.

11 Claims, 2 Drawing Sheets

MEDICAL DEVICE TRANSPORTER

BACKGROUND OF THE INVENTION

This invention relates to instrumentation carrying devices to be used on portable stretchers of the type used in ambulances.

DESCRIPTION OF THE PRIOR ART

The prior art in the field of the placement of instrumentation on stretchers while patients are being transported does not include a single convenient and removable carrying device for the instrumentation. Often times in the prior art, instruments are merely laid down on the side of the patient, or strewn across the patient during transport. In other prior art devices the life support and monitoring instrumentation is built into the stretcher and cannot be removed. Similarly, there has been no convenient special provision for the handling of life support apparatus to be used for a stretcher patient.

Currently devices such as suction pumps, blood pressure gauges, pulse meters, and the like when used in conjunction with a stretcher patient are simply placed alongside the stretcher, on top of the patient as the stretcher is being moved, or secured to the underside of the stretcher. When these devices are placed in these ways, they are inconvenient for paramedics and potentially uncomfortable or dangerous for the patient. Still further, when a patient is being transported down a stairway or ladder, the placement of instrumentation becomes extremely difficult because of the danger of its falling off or being damaged.

U.S. Pats. Nos. 4,352,991, 4,060,079, 3,954,100 and 3,504,386 are representative of the prior art. None of these prior art patents discloses or suggests a portable single piece molded snap lock on unit which may be used in transporting patients on a stretcher, provided by this invention.

BRIEF SUMMARY OF THE INVENTION

This invention is a single piece instrumentation carrier, preferably of molded plastic, which may be mounted on a stretcher or placed on the ground at an oblique angle. The invention provides for easy observation of the instrument gauges while on the stretcher or on the ground. The invention also includes depending legs which have annular grooves or recesses therein which snap in place over the horizontal carrying bars on a stretcher.

DESCRIPTION OF THE PREFERRED EMBODIMENT

Figure 1:
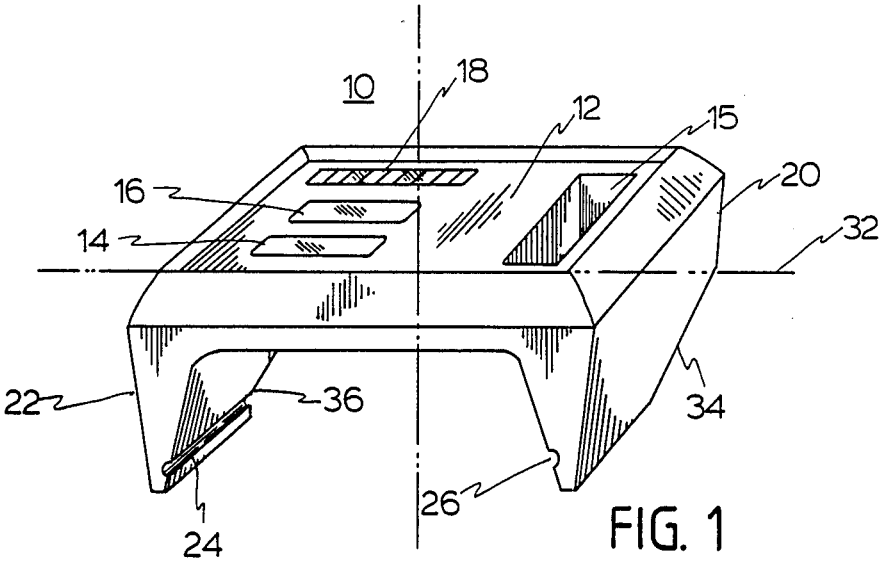
FIG. 1 shows a perspective view of the instrumentation carrying device of this invention.

The instrumentation carrying apparatus of FIG. 1 is a single piece which, when placed on the arms or a side bar of a stretcher, provides a bridge over the top of the stretcher and the patient on the stretcher. The bridge 10 includes an upper surface 12 which provides for mounting of displays or gauges 14 and 16, and controls for the instrumentation 18. While the apparatus is preferably of molded plastic, other materials which can be welded or otherwise joined to form a unitary structure may be used.

The instrumentation used with this bridge carrying apparatus may be either equipment for monitoring a patient's condition or equipment for providing life support to the patient while the patient is being transported.

Figure 3:
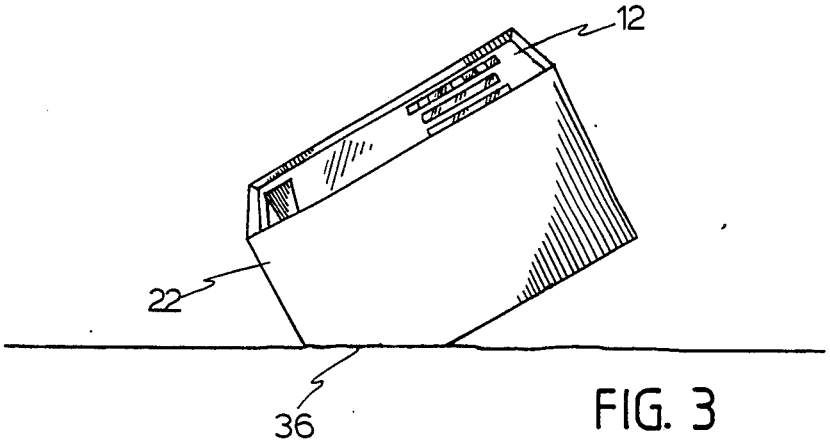
FIG. 3 depicts the apparatus of FIG. 1 when placed upon its oblique surface for providing an oblique angle with respect to the horizontal for instrument display.
Figure 2:
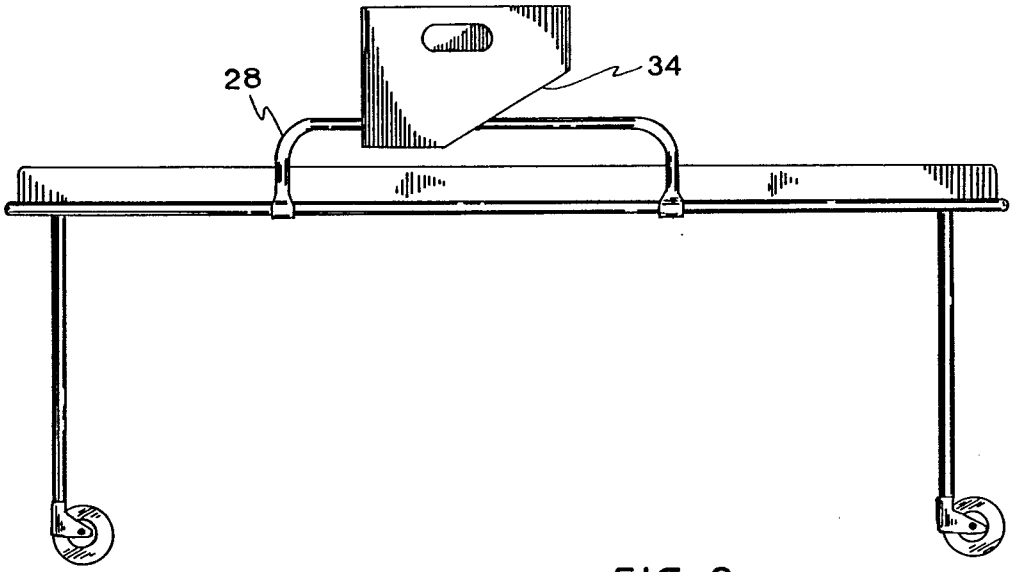
FIG. 2 shows a perspective view of the apparatus of FIG. 1 when placed across the bars on the sides of a stretcher.
Figure 4:
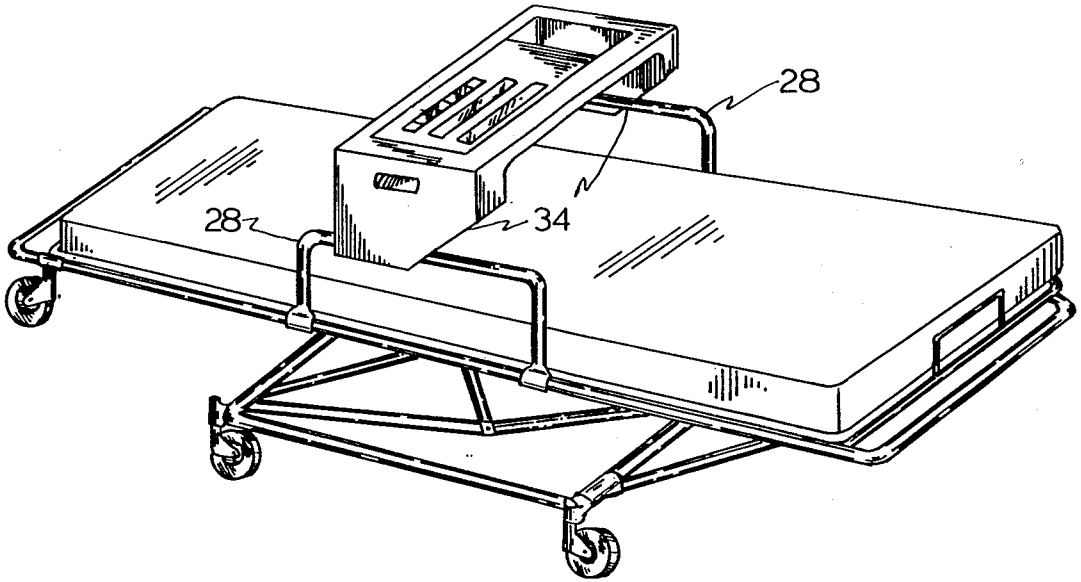
FIG. 4 depicts the apparatus of FIG. 1 placed across the bars on the sides of the stretcher and viewed from a perspective above and to the side of the device of this invention.

The bridge carrying apparatus includes legs 20 and 22 which depend downward from the bridge and which by means of annular recesses 24 and 26 provide a snap on or detent connection to the bars on the stretcher 28, as is shown generally in FIG. 2. The legs also include cut off portions which are preferably at an angle of 30°, which together form a plane which is oblique to the vertical axis 30 of the bridge 10. The cut off portions are shown in FIG. 1 as surfaces 34 and 36. The plane of the cut off portions formed by surfaces 34 and 36 is generally parallel to axis 32 and oblique to axis 38. By this arrangement, as depicted in FIG. 3, when the apparatus 10 is placed on the ground, resting on surfaces 34 and 36 respectively, the upper surface of the bridge 12 is held at an angle with respect to the ground, thereby providing for ease of observation of the instrumentation while the apparatus has been removed from the stretcher to allow patient placement on the stretcher or to permit carrying the equipment to the patient.

The top of the bridge may also include a compartment 15 which is used to hold probes which are used with the instrumentation of this invention.

This invention provides a convenient snap on means 24, 26 which engages the bars 28 of a standard stretcher, and provides a convenient means for transporting a patient with instrumentation attached thereto. In the preferred embodiment the depressions 24 and 26 comprise the snap on means when used in combination with the molded plastic bridge which is resilient and which forces the depressions 24 and 26 against a bar of the stretcher. The depressions 24 and 26 are semicircular and fit against the carrying bars 28 as illustrated in FIG. 2. The bridge carrying means may also be snapped onto other bars along the side of the stretcher. Still further, this invention provides for a convenient placement of the instrument support apparatus on the ground so that instrumentation can be easily observed by medical personnel who are handling the stretcher.

By placement of the entire instrumentation in a single bridge apparatus which spans the patient during transport, the problems associated with loose placement of instrumentation alongside or on top of the patient are eliminated. By this invention, there is no discomfort to the patient due to instrumentation, and the problems associated with instrumentation falling off a stretcher during moving are eliminated.

What is claimed is:

1. A unitary bridge apparatus for holding patient instrumentation on a stretcher comprising:

means for mounting said instrumentation on said apparatus;

means for mounting equipment monitoring displays on said apparatus;

means for storing probes for said instrumentation on said apparatus; and resilient downwardly dependent legs having:

recesses therein adapted for mounting said apparatus on the side bars of a stretcher in a snap action for securing said apparatus to said stretcher; and angled surfaces adapted for permitting said apparatus to rest in a stable, tilted position on a horizontal surface.

2. The apparatus of claim 1 wherein said legs are attached to bars on said stretcher which are parallel along the sides of said stretcher.

3. The apparatus of claim 2 wherein said sides are parallel to the long axis of said stretcher.

4. The apparatus of accordance of the claim 1 wherein said apparatus forms a bridge over the top of said stretcher.

5. The apparatus of claim 1 wherein said apparatus has parallel sides which depend downward and snap onto said side bars.

6. The apparatus of claim 1 wherein said bridge apparatus is constructed of a single piece of molded plastic.

7. The apparatus of claim 1 wherein said bridge is resilient and provides a portion of the snap action for securing said apparatus to said stretcher.

8. The apparatus of claim 1 wherein said depending legs means are adapted to allow said bridge to rest in a stable, upright position on a horizontal surface.

9. An apparatus for holding patient instrumentation on a stretcher comprising in combination:

a molded plastic equipment carrying bridge placed across the narrow width of said stretcher wherein said stretcher has sides which are generally parallel to the body of a person placed upon said stretcher and parallel carrying bars on each of said sides for carrying such stretcher, and wherein said bridge is adapted to be fixed to a portion of said carrying bars and having means for holding said equipment; and molded plastic downwardly dependent legs means having angled surfaces adapted for resting said apparatus in a stable, tilted position a horizontal surface.

10. The apparatus of claim 9 wherein said surfaces for resting are parallel to the long axis of said stretcher and at an oblique angle to an axis which is perpendicular to the top surface of said stretcher.

11. The apparatus of claim 9 wherein said molded plastic body has a surface adapted for resting said apparatus in a stable, upright position on a horizontal surface.

* * * * *